US007316107B2

(12) United States Patent
Aratsuka et al.

(10) Patent No.: US 7,316,107 B2
(45) Date of Patent: Jan. 8, 2008

(54) DEVICE FOR PURIFYING THE EXHAUST GASES OF DIESEL ENGINES

(75) Inventors: Yoshitaka Aratsuka, Kanagawa (JP); Hirofumi Hashimoto, Kanagawa (JP); Takuo Nishi, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 69 days.

(21) Appl. No.: 11/091,409

(22) Filed: Mar. 29, 2005

(65) Prior Publication Data

US 2005/0217255 A1 Oct. 6, 2005

(30) Foreign Application Priority Data

Mar. 30, 2004 (JP) ..... 2004-100850

(51) Int. Cl.
*F01N 3/00* (2006.01)
*F01N 3/11* (2006.01)
*F01N 7/00* (2006.01)

(52) U.S. Cl. ..... 60/297; 60/295; 60/311; 60/324

(58) Field of Classification Search ..... 60/297, 60/311, 295, 324
See application file for complete search history.

(56) References Cited

U.S. PATENT DOCUMENTS 4,835,964 A * 6/1989 Kume et al. ..... 60/285
5,097,665 A * 3/1992 Kammel ..... 60/275
5,655,366 A * 8/1997 Kawamura ..... 60/286
5,930,995 A * 8/1999 Watanabe et al. ..... 60/311
6,367,245 B1 * 4/2002 Yasui et al. ..... 60/277
6,598,387 B2 * 7/2003 Carberry et al. ..... 60/297
6,802,180 B2 * 10/2004 Gabe et al. ..... 60/285
6,817,172 B2 * 11/2004 Tamura ..... 60/285
6,817,174 B1 * 11/2004 Igarashi et al. ..... 60/295
6,877,312 B2 * 4/2005 Nakatani et al. ..... 60/288
6,892,531 B2 * 5/2005 Rim ..... 60/295

(Continued)

FOREIGN PATENT DOCUMENTS

| | | |
|---|---|---|
| EP | 0 445 567 A1 | 9/1991 |
| JP | 5-44436 | 2/1993 |
| JP | 2001-336433 | 12/2001 |
| JP | 2003-343287 | 12/2003 |

*Primary Examiner*—Thomas Denion
*Assistant Examiner*—Loren Edwards
(74) *Attorney, Agent, or Firm*—McGinn IP Law Group, PLLC

(57) ABSTRACT

In a diesel engine provided with a diesel particulate filter 81 and an exhaust throttle valve 9, noise is decreased that is produced when the exhaust throttle valve is returned back to the fully opened state after a diesel particulate filter 81 has been regenerated by oxidizing and removing the particulate matter deposited thereon. The exhaust system of the diesel engine is equipped with the diesel particulate filter 81 and a catalyst 82 on the upstream thereof, and is further equipped with the exhaust throttle valve 9 on the downstream. The diesel particulate filter 81 is regenerated by operating the diesel engine in a state where the exhaust throttle valve 9 is opened to a small degree. When the regeneration has finished, the diesel engine is run at a decreased rotational speed and, thereafter, the exhaust throttle valve 9 is returned back to the fully opened state. When the engine is run at a decreased rotational speed, the pressure in the exhaust system decreases making it possible to greatly decrease the noise that generates at the time of the opening of the exhaust throttle valve 9.

10 Claims, 5 Drawing Sheets

U.S. PATENT DOCUMENTS 6,901,751 B2 * 6/2005 Bunting et al. ..... 60/297
6,966,179 B2 * 11/2005 Onodera et al. ..... 60/295
7,104,050 B2 * 9/2006 Sato et al. ..... 60/295
2004/0194450 A1 * 10/2004 Tanaka et al. ..... 60/285

* cited by examiner

DEVICE FOR PURIFYING THE EXHAUST GASES OF DIESEL ENGINES

BACKGROUND OF THE INVENTION

1. Field of the Invention

The present invention relates to a device for purifying the exhaust gases and a control unit therefor, which are provided in an exhaust system of an engine in order to remove pollution components contained in the exhaust gases emitted from a diesel engine and, particularly, to remove particulate matter which is to be reduced in connection with exhaust gas regulations.

2. Description of the Related Art

As an important way to protect the environment, regulations have now been legislated for reducing nitrogen oxides (NOx) and hydrocarbons (HC) which are pollution components contained in the exhaust gases emitted from the engines for vehicles, and a variety of technologies have been vigorously developed to reduce such pollution components. In particular, the regulations concerning the exhaust gases of diesel engines are becoming stringent in recent years, and it is expected that more strict regulations will be legislated in the future. A diesel engine is the one in which the air fed into a cylinder is compressed to reach high temperature and a fuel is injected into the compressed air so as to be burned, and features a higher thermal efficiency than that of the gasoline engines. Therefore, the emission of carbon dioxide ($CO_2$) in the diesel engine is less than the gasoline engine correspondingly, it is strongly demanded to reduce the emission of particulate matter (PM) and Nox in the diesel engine.

The particulate matter is exhausted in the form of particles of carbon and unburned fuel components as a result of incomplete combustion of the fuel injected into the cylinders. In some operating conditions, the diesel engine exhausts the particulate matter in increased amounts due to defective mixing of the air and the injected fuel. In particular, when the so-called EGR is executed to recirculate the exhaust gas being mixed with the air into the cylinders of the diesel engine in order to decrease the NOx, the air is fed in a decreased amount into the cylinder and a maximum temperature of combustion gas decreases causing the particulate matter to be emitted in increased amounts. Thus, there exists a conflicting nature between decreasing the particulate matter and decreasing the NOx.

In order to prevent the emission of the particulate matter, there has been proposed a technology of providing the exhaust system of the diesel engine with a filter called diesel particulate filter (DPF) to trap the particulate matter. The DPF usually comprises a ceramic body such as porous cordierite in which a number of fine passages are formed in the axial direction, the inlets and outlets of the neighboring passages being alternately closed. The exhaust gases of the diesel engine flow toward the downstream passing through the porous ceramic walls between the neighboring passages whereby the particulate matter in the form of fine particles is trapped. Instead of using the porous ceramic body, there is another means to use a nonwoven fabric of a fine texture comprising a heat-resistant fiber such as ceramic fiber. To prevent the emission of particulate matter, further, there has been known a technology of providing the exhaust system with an oxidizing catalytic device. The oxidizing catalytic device has many passages formed in the ceramic substrate and the surface of the passages are coated with a catalyst of a noble metal such as platinum, palladium or rhodium. The exhaust gases flow through the passages in the oxidizing catalytic device whereby the particulate matter in the exhaust gases is combined with oxygen in the exhaust gases from the diesel engine due to the catalytic action, and is converted into $CO_2$ and the like. Such catalyst is often carried on the surfaces of the DPF mentioned above.

The particulate matter trapped on the DPF increases as a result of the repetitive operation of the diesel engine installed on a vehicle. When the particulate matter deposits in large amounts, the filter is choked causing such troubles as increased back pressure of the engine. The large amounts' deposition also causes thermal damage to the DPF due to the combustion of a lot of the particulate matter, which occurs when the temperature of the exhaust gas is elevated during the high-load operation of the engine. To prevent such troubles, the so-called DPF regeneration must be executed to restore the function of the DPF by suitably removing the deposited particulate matter.

As means for regeneration, there has been known a system of burning the particulate matter by heating by using an electric heater or a burner. When the system for burning the particulate matter is employed, however, the DPF must be combined with the electric heater; i.e., the DPF becomes complex and expensive. Besides, the particulate matter cannot be trapped while the deposited particulate matter is being burned, consequently, the system must be such that the exhaust passage is provided with a plurality of DPFs in parallel to alternately execute the trapping and the burning, arousing a problem in that the system becomes bulky.

In view of this problem in recent years, attention has been given to a system of regenerating the DPF by arranging an oxidizing catalyst on the upstream of the exhaust gas of the DPF. The oxidizing catalyst oxidizes the unburned components in the exhaust gas to elevate the temperature of the exhaust gas, and removing the particulate matter trapped by the DPF is carried out continuously while the engine is in operation by the exhaust gas of elevated temperature. Instead of providing the catalyst on the upstream side, there can be further contrived a method of coating the catalyst on the surfaces of the DPE, e.g., carrying the so-called NOx occluding and reducing catalyst on the surfaces of the DPF on the upstream thereof to continuously oxidize and remove the trapped particulate matter by utilizing active oxygen that is generated at the time of occluding and reducing the NOx. The DPF which has the catalyst on the upstream thereof and is regenerated by continuously removing the trapped particulate matter is referred to here as continuously regenerating DPF.

The continuously regenerating DPF removes the particulate matter by the action of the catalyst provided on the upstream thereof and, hence, does not exhibit a sufficient regenerating function when the temperature of the catalyst is not higher than the activating temperature and cannot be continuously regenerated, such as the ordinary catalytic devices does not exhibit a sufficient function in low temperature. A temperature of about 350° C. is necessary for the catalyst to be activated and favorably regenerated. However, during the low-load operation of the diesel engine where the fuel is injected in small amounts, the temperature of the exhaust gas becomes considerably low. If this operating condition continues for extended periods of time, the temperature of the catalyst becomes lower than the activating temperature. Therefore, the particulate matter deposits on the DPF and could cause high back pressure of the engine or melt-damage to the DPF due to the combustion of the particulate matter of large amounts when the temperature of the exhaust gas is elevated. Even in the continuously regenerating DPF, therefore, the particulate matter must be removed by such a method as activating the catalyst by elevating the temperature of the exhaust gas when the particulate matter has deposited in a predetermined amount on the DPF. The above-mentioned regeneration of the DPF is hereinafter referred to as forced regeneration.

The temperature of the exhaust gas of the diesel engine can be elevated by means called post-injection. In the post-injection, an additional fuel is injected into the engine cylinder in the expansion stroke or in the exhaust stroke of the diesel engine, so that the fuel does not burn in the cylinder but burns or be oxidized chiefly in the exhaust pipe and in the catalyst placed therein to elevate the temperature of the exhaust gas. Generally, the fuel is injected after the final stage of the expansion stroke to obtain a favorable effect. The post-injection is such that the additional fuel is fed from a fuel injection nozzle that has been provided already in the cylinder of the diesel engine, and does not require any additional device, which is an advantage. The amount of the post-injection and the number of times thereof may be controlled to adjust the temperature of the exhaust gases to be elevated.

The temperature of the exhaust gas of the engine also elevates if the timing of the ordinary fuel injection of the diesel engine is delayed. The ordinary fuel injection takes place from the end of the compression stroke to the expansion stroke to burn the fuel in the engine cylinder, and delaying the timing of the ordinary fuel injection increases portion of the fuel that does not contribute to producing the torque of the engine, so that the temperature of the exhaust gas rises. A so-called multi-injection is preferred for realizing the delay in the injection timing. The multi-injection is to inject the fuel in a manner of being divided into a plurality of times. In the diesel engine, the controlled delaying of the injection timing can be easily performed by the injection of the fuel being divided into a plurality of times, the fuel that is continuously injected ordinary from the end of the compression stroke to the expansion stroke.

To elevate the temperature of the exhaust gases to maintain catalytic activity of the continuously regenerating DPF, the post-injection or the multi-injection is an effective means, however, this is often not enough to sufficiently elevate the temperature. Therefore, there can be contrived means for promoting the regeneration of the DPF by providing an exhaust throttle valve downstream of the continuously regenerating DPF. The exhaust throttle valve squeezes the exhaust passage by decreasing the opening degree of the valve when the forced regeneration based on the post-injection or the like is executed, to prevent the radiation of heat from the continuously regenerating DPF and, hence, to retain the temperature. Such device for purifying the exhaust gases of diesel engines, i.e., the combination of the continuously regenerating DPF and the exhaust gas throttle valve, has been known as taught in, for example, JP-A-2003-343287. Here, it is noted that if the exhaust gas is squeezed by using the exhaust gas throttle valve, the engine back pressure rises and an increased load is exerted on the engine. Accordingly, the amount of fuel injection further increases and the temperature of the exhaust gas is elevated. The device mentioned above for purifying the exhaust gas of the diesel engine will now be described with reference to FIG. 5.

FIG. 5 schematically illustrates a diesel engine which has a continuously regenerating DPF and an exhaust throttle valve, and drives a vehicle. The air is fed into the cylinders of a diesel engine body 1 through an air cleaner 2 and an intake pipe 3. The fuel is injected into the cylinders from the fuel injection nozzles 4 at the end of the compression stroke, mixed with the compressed air, and burns in the cylinders to produce the power. The exhaust gases after burned are discharged into an exhaust pipe 5 and are partly recirculated into the intake pipe 3 through an EGR passage 6. The recirculation purposes chiefly for preventing the generation of NOx. The amount of the exhaust gases to be recirculated is controlled by the EGR valve 7.

In the exhaust pipe 5, there are arranged a continuously regenerating DPF 8 as well as an exhaust throttle valve 9 on the downstream thereof. The exhaust throttle valve 9 is opened and closed by a fluid pressure actuator that is controlled by an electromagnetic valve 91, and is, usually, maintained fully opened while the diesel engine is in operation. The continuously regenerating DPF 8 includes a DPF 81 having many passages formed in the ceramic body in the axial direction thereof and an oxidizing catalyst 82 arranged on the upstream thereof. The continuously regenerating DPF 8 is further provided with a pressure differential sensor 83 for detecting the pressure differential between the pressure on the upstream of the DPF 81 and the pressure on the downstream thereof, an inlet temperature sensor 84 for detecting the temperature of the exhaust gas on the upstream of the oxidizing catalyst 81, and an outlet temperature sensor 85 for detecting the temperature on the outlet side thereof (inlet side of the DPF 81). Detection signals of these sensors are input to an engine control unit (ECU) 10.

While the diesel engine is in operation, the fuel injected from the fuel injection nozzle 4 burns in the cylinder, and the exhaust gases after the combustion are emitted into the exhaust pipe 5. When the exhaust gases pass through the continuously regenerating DPF 8, the particulate matter contained therein is trapped on the wall surfaces among many passages formed in the DPF 81 in the axial direction thereof, and the exhaust gases from which the particulate matter is removed are discharged to the downstream of the DPF 81. While the diesel engine is in operation, the particulate matter trapped and deposited on the DPF 81 is oxidized and removed upon being bonded with oxygen and the like in the exhaust gases heated at a high temperature by the action of the oxidizing catalyst 82.

However, when the diesel engine is operated carrying a low load for extended periods of time, the temperature of the exhaust gas decreases, the activity of the oxidizing catalyst 82 decreases. Accordingly, the particulate matter is trapped and deposits in increased amounts and pressure differential increases between the pressure on the upstream of the DPF 81 and the pressure on the downstream thereof. When low temperatures are detected by the inlet temperature sensor 84 and the outlet temperature sensor 85 of the oxidizing catalyst 82 and, besides, when the pressure differential detected by the pressure differential sensor 83 exceeds a predetermined value, the ECU 10 produces an instruction signal for effecting the post-injection to elevate the temperature of the exhaust gases, which is for forced regenerating the DPF 81. At the same time, the ECU 10 sends an instruction to the electromagnetic valve 91 to decrease the opening degree of the exhaust throttle valve 9, and executes a control to strongly squeeze the exhaust gas flow.

In the forced regeneration, the fuel fed by the post-injection is oxidized and burns through the exhaust pipe 5 or the oxidizing catalyst 82, and the temperature of the exhaust gases is elevated. Further, the downstream of the continuously regenerating DPF 8 is squeezed by the exhaust throttle valve 9, the high temperature in the continuously regenerating DPF 8 is retained and an increased load is exerted on the engine. Therefore, the oxidizing catalyst 82 is fully activated to promote the regeneration of the DPF 81.

SUMMARY OF THE INVENTION

The particulate matter trapped by the continuously regenerating DPF as described above can be effectively oxidized and removed relying upon a combination of using the exhaust throttle valve and elevating the temperature of the exhaust gas by the post-injection or the like. Here, however, if the exhaust throttle valve provided in the exhaust pipe is squeezed at the time of forced regeneration of the DPF, the resistance to exhaust gas discharging in the diesel engine so increases as to affect the operation thereof to a serious degree. Therefore, when the exhaust throttle valve is used in combination at the time of executing the forced regeneration, it is desired to bring the vehicle into a halt and conduct the forced regeneration in the idling condition of the diesel engine.

Further, after the particulate matter trapped by the DPF is removed by the forced regeneration, the exhaust throttle valve must be returned to the fully opened state to return the diesel engine back to the normal operation. It is, however, found that when the exhaust throttle valve provided downstream of the continuously regenerating DPF is quickly returned back to the fully opened state, a large noise generates to a degree which is offensive to the ears.

If the forced regeneration such as the post-injection is conducted by closing the exhaust throttle valve, the exhaust gas of a high pressure is accumulated on the upstream side. The above noise is produced by the impulsive pressure waves that is generated due to the instantaneously pressure drop of the accumulated exhaust gas to near the atmospheric pressure, when the exhaust throttle valve opens and the exhaust gas flows into the exhaust pipe on the downstream. The device for the purifying such as the continuously regenerating DPF has a large sectional area as compared to that of the exhaust pipe, and permits accumulating the exhaust gas of a large volume herein to produce noise of a further increased level. It is therefore a purpose of the present invention to decrease the noise at the time when the exhaust throttle valve is returned back to the fully opened state, in a diesel engine which is equipped with the continuously regenerating DPF and the exhaust throttle valve in combination.

In view of this purpose, the present invention has an object of decreasing the noise at the time when the exhaust throttle valve is returned back to the fully opened state after the forced regeneration of the continuously regenerating DPF has been finished. And the present invention provides an system, in which, when the forced regeneration is finished, the engine is operated at a decreased rotational speed and, thereafter, the exhaust throttle valve is fully opened.

Namely, the present invention is concerned with a diesel engine comprising:

a continuously regenerating DPF having a diesel particulate filter for trapping particulate matter contained in the exhaust gases, and a catalyst provided on the upstream thereof; and an exhaust throttle valve on the downstream of the continuously regenerating DPF;

wherein when the diesel engine is operated in a state where the exhaust throttle valve is opened to a small degree in order to regenerate the diesel particulate filter by oxidizing and removing the particulate matter deposited on the diesel particulate filter, the diesel engine is operated at a decreased rotational speed at a moment when the regeneration of the diesel particulate filter has finished and, thereafter, the exhaust throttle valve is opened to a large degree.

Even the continuously regenerating DPF having a catalyst on the upstream of the DPF, often makes it necessary to carry out forced regeneration of the DPF due to a decrease in the catalytic activity caused by a drop in the temperature of the exhaust gas. The DPF can be forcibly regenerated most effectively if the exhaust throttle valve is used in combination.

The system of the present invention effectively decreases the noise that generates at the time of returning the exhaust throttle valve back to its fully opened state, the exhaust throttle valve which is opened to a small degree during the diesel engine has been operated for forced regeneration. That is, in the present invention, when the particulate matter has deposited on the DPF in amounts greater than a predetermined amount and when the DPF is forcibly regenerated by opening the exhaust throttle valve to a small degree, the diesel engine, after the completion of the regeneration, is operated at a rotational speed lower than the engine rotational speed of during the regeneration and, thereafter, the exhaust throttle valve is opened to a large degree and is returned back to the fully opened state. When the rotational speed of the engine is lowered prior to opening the exhaust throttle valve, the flow rate of the exhaust gas and the pressure decrease and, hence, the pressure decreases in the continuously regenerating DPF. Therefore, the noise that generates at the opening of the exhaust throttle valve is greatly decreased as compared to that of the prior art which does not conduct the operation at a decreased rotational speed. Besides, the noise can be decreased without adding any particular devices.

When the diesel engine is operated in a state where the exhaust throttle valve is opened to a small degree to regenerate the diesel particulate filter, it is preferable that the vehicle is brought into a halt and the diesel engine is operated in idling condition as described in claim 2. Further, in conducting the idling operation as described in claim 3, a feedback control is executed with the idling rotational speed as a target value and when the regeneration of the diesel particulate filter is finished, the target value in the feedback control is decreased to decrease the rotational speed of the diesel engine.

During the continuously regenerating DPF provided in the exhaust system of the diesel engine is regenerated in a state where the exhaust throttle valve is opened to a small degree, an increased load is exerted on the engine to seriously affect the driving of the vehicle. If the regeneration is executed by bringing the vehicle into a halt and by operating the diesel engine in idling condition as described in claim 2, it is allowed to avoid the disadvantageous effect upon operating the vehicle. As described in claim 3, further, the rotational speed can be easily controlled in a stable operating state if the diesel engine is operated by the feedback control with the idling rotational speed as a target value in regenerating the continuously regenerating DPF and the target value is lowered after the completion of the regeneration.

In regenerating the diesel particulate filter as described in claim 4, the fuel may be added by post-injection from a fuel injection nozzle in the expansion stroke or in the exhaust stroke of the diesel engine to elevate the temperature of the exhaust gas and to promote the oxidation reaction. In regenerating the diesel particulate filter as described in claim 5, further, the fuel injection is shifted into injecting the fuel into the diesel engine being divided into a plurality of times, i.e., shifted into a multi-injection and after the temperature of the exhaust gases has reached a predetermined value, the fuel is added by the post-injection.

In forcibly regenerating the DPF, if the fuel is added by the post-injection from the fuel injection nozzle as described in claim 4 to elevate the temperature of the exhaust gases and to promote the oxidation reaction, the fuel is fed from the fuel injection nozzle that has been provided already for the diesel engine, and no particular device is required for adding the fuel. In regenerating the continuously regenerating DPF, further, the fuel injection into the diesel engine is shifted to the multi-injection of injecting the fuel being divided into a plurality of times to elevate the temperature of the exhaust gases as described in claim 5. In this case, the temperature of the catalyst has been elevated to be not lower than the activating temperature by the time the post-injection is effected. Therefore, the fuel added by the post injection establishes a sufficient degree of oxidation reaction in the catalyst making it possible to efficiently remove by combustion the particulate matter deposited on the DPF.

Here, the amount of formation of the particulate matter and the amount of its deposition on the DPF vary depending upon the operating conditions of the vehicle, and difficulty is involved in determining the necessity for the forced regeneration. As described in claim 6, therefore, it is desired that an alarm device is provided to let the driver know the fact that the particulate matter has deposited in amounts greater than a predetermined amount on the diesel particulate filter. This enables the driver to reliably judge the necessity for executing the forced regeneration and to take a suitable countermeasure.

DETAILED DESCRIPTION OF THE PREFERRED EMBODIMENTS

Figure 1:
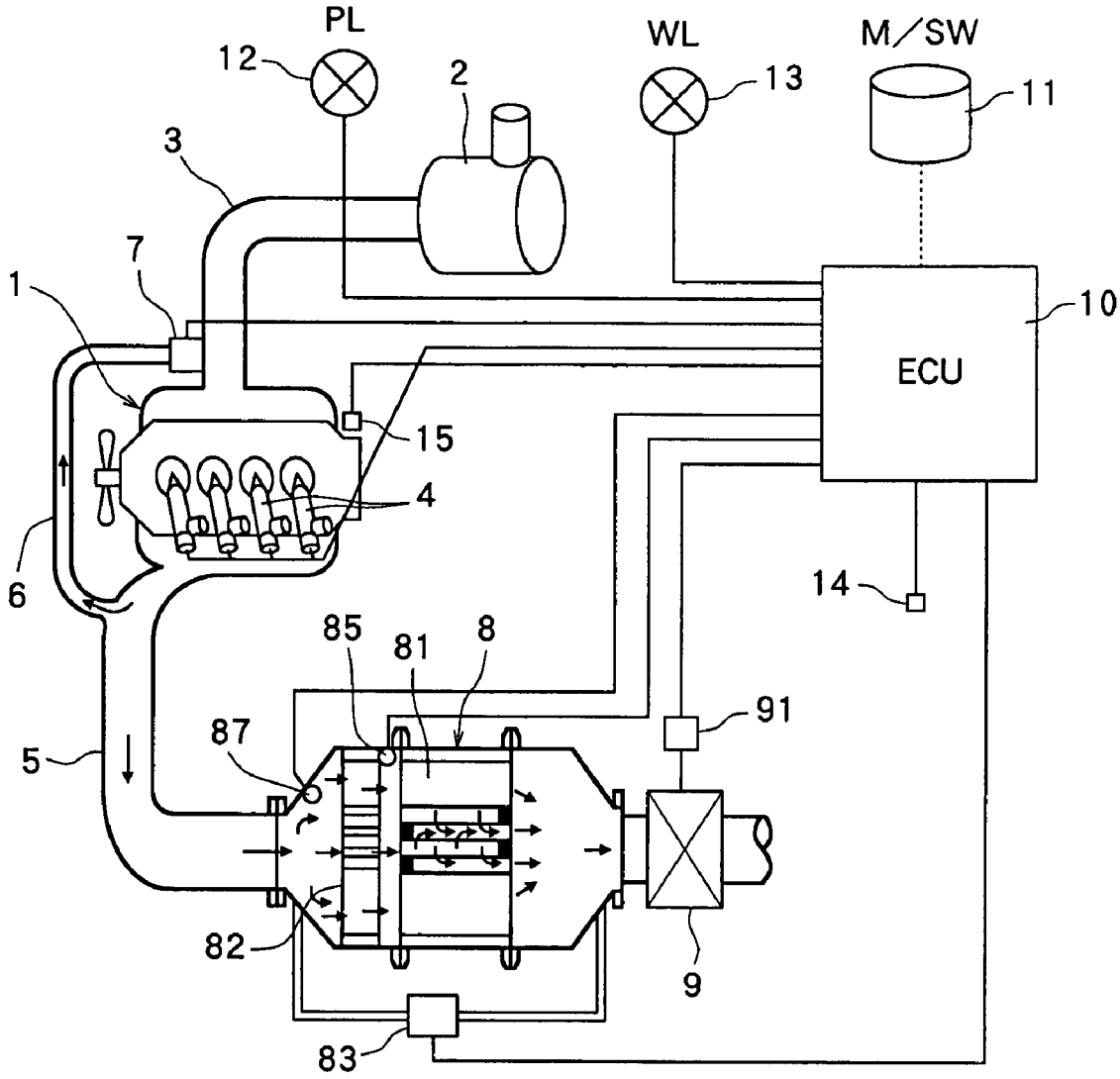
FIG. 1 is a drawing schematically illustrating a device for after-treating the exhaust gases of a diesel engine according to the present invention.
Figure 2:
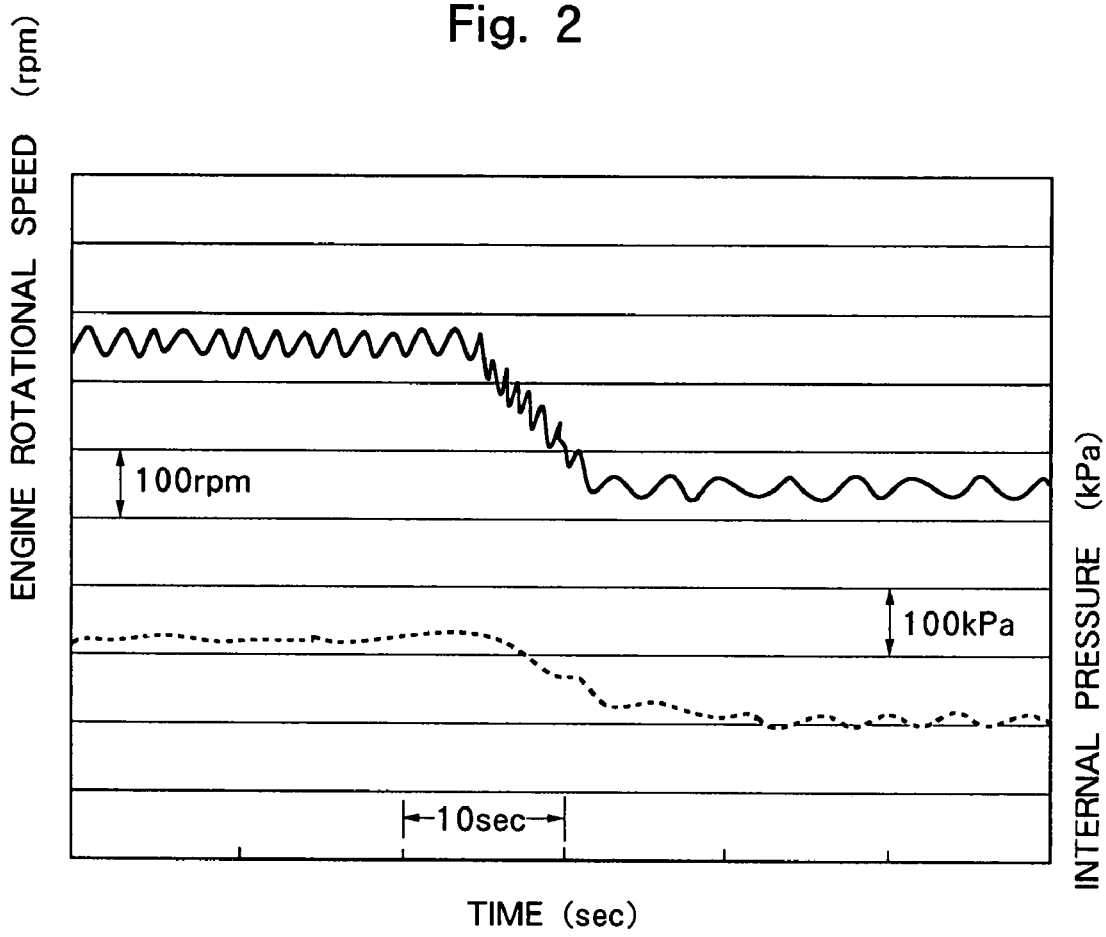
FIG. 2 is a diagram illustrating a change in the engine rotational speed and a change in the internal pressure in the continuously regenerating DPF as controlled by the present invention.

Hereinafter, the device for purifying the exhaust gases of a diesel engine according to the present invention will be described with reference to the drawings. FIG. 1 is a drawing schematically illustrating a device for purifying the exhaust gases of a diesel engine according to the present invention, wherein those corresponding to the parts and components of the prior art (FIG. 5) are denoted by the same reference numerals. FIG. 2 is a graph illustrating a change n the diesel engine rotational speed and a change in the internal pressure in the continuously regenerating DPF during the control operation is executed according to the present invention.

Figure 5:
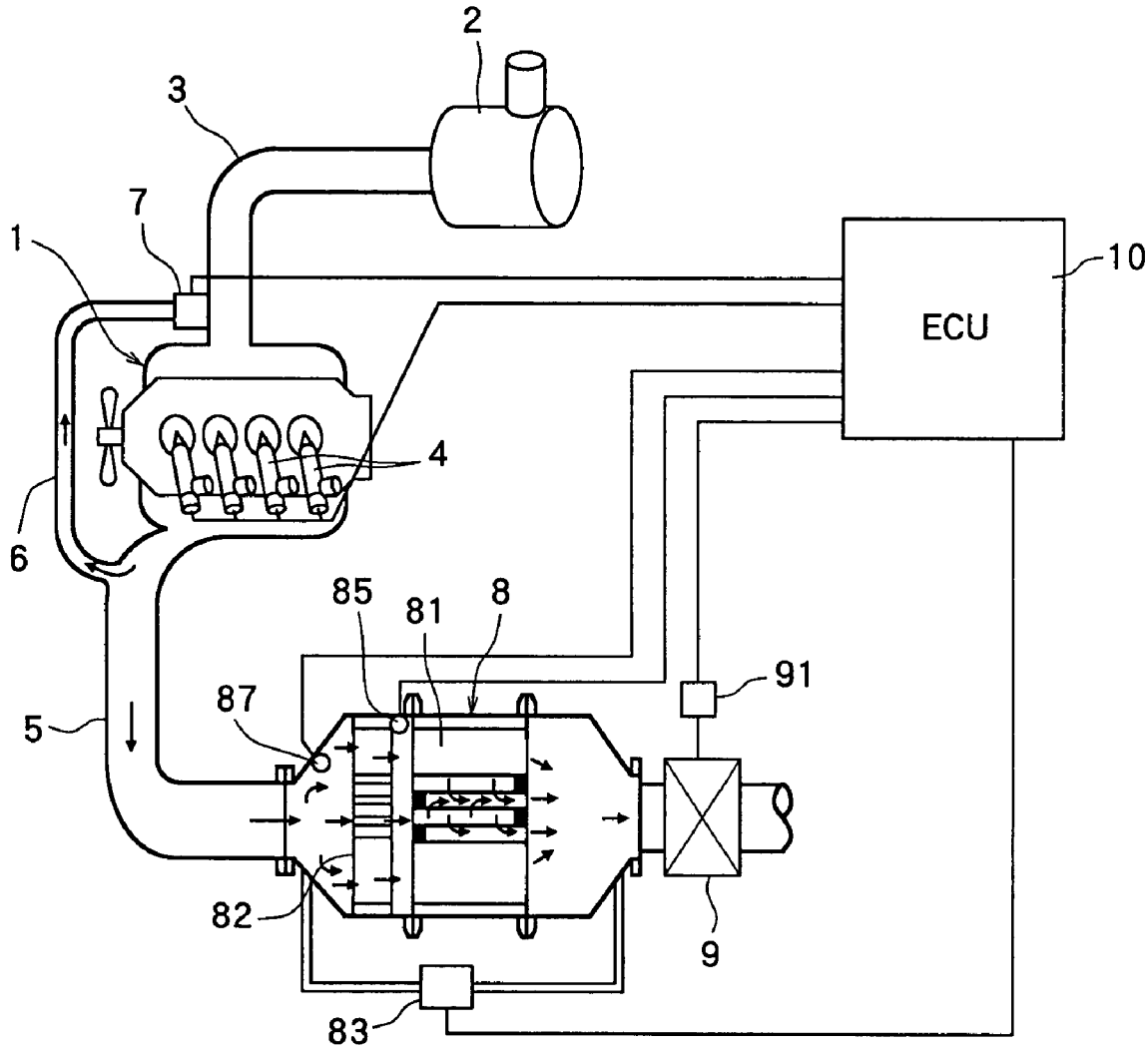
FIG. 5 is a drawing schematically illustrating a conventional device for after-treating the exhaust gases of a diesel engine.

The fundamental elements constituting the device for purifying the exhaust gases of the diesel engine of the present invention and the method of its operation are not particularly different from those of the conventional device illustrated in FIG. 5. Namely, in the cylinder of the diesel engine body 1, the fuel injected from the fuel injection nozzle 4 is mixed with the air fed from the intake pipe 3 and burns, and the exhaust gases after burned are emitted into the exhaust pipe 5. The diesel engine is equipped with a so-called common rail fuel injection device which injects the fuel from the fuel reservoir pipe (common rail) into the cylinders of the engine through the electromagnetic valve-controlled fuel injection nozzles. Accordingly, the fuel of a very high pressure is injected while precisely controlling the amounts of injection and the timings of injection.

In the exhaust pipe 5, there is arranged a continuously regenerating DPF 8 having a DPF 81 and an oxidizing catalyst 82 on the upstream thereof. The DPF 81 is a honeycomb filter of the so-called wall flow type having many passages formed in parallel in a porous ceramic body such as cordierite or the like and in which the inlets and outlets of the passages are alternately closed, and works to trap the particulate matter as the exhaust gases pass through the wall surfaces among the passages.

Further, the oxidizing catalyst 82 is the one obtained by coating the surfaces of the substrate of, for example, honeycomb cordierite with active alumina to form a washcoat layer and by carrying a catalytically active component of a noble metal such as platinum, palladium or rhodium on the coated layer. The oxidizing catalyst 82 works to oxidize HC and CO which are unburned components in the exhaust gases to form $H_2O$ and $CO_2$ or works to oxidize NO to form $NO_2$. Heat is produced in the step of reaction by the oxidizing catalyst 82 and the temperature of the exhaust gases elevates, whereby the particulate matter trapped by the DPF 81 is oxidized and removed. Thus, the DPF 81 is, usually, regenerated continuously. As the DPF 81 and the oxidizing catalyst 82, further, it is allowable to use any other devices that have been traditionally used, as a matter of course. As the DPF 81, for example, there can be used the DPF obtained by coating the surfaces of the passages thereof with a catalyst similar to that of the above oxidizing catalyst.

An exhaust throttle valve 9 is disposed downstream of the continuously regenerating DPF 8. The exhaust throttle valve 9 is a widely used butterfly valve which is actuated by the pneumatic pressure or by a vacuum actuator. The actuator is controlled by an electromagnetic valve 91 and is maintained fully opened while the diesel engine is in normal operation preventing an increase of the resistance to exhaust gas discharging in the diesel engine. Like in the prior art of FIG. 5, further, the continuously regenerating DPF 8 is further provided with a pressure differential sensor 83 for detecting the pressure differential between the pressure on the upstream of the DPF 81 and the pressure on the downstream thereof, and an inlet temperature sensor 84 and an outlet temperature sensor 85 for detecting the temperature of the exhaust gas on the inlet side and on the outlet side of the oxidizing catalyst 81, respectively. Detected signals of these sensors are transferred to an engine control unit (ECU) 10.

As described above, when the diesel engine 1 is operated carrying a small load for extended periods of time, the temperature of the exhaust gas decreases, the activity of the oxidizing catalyst 82 decreases, and the particulate matter trapped by the DPF 81 deposits in increased amounts. It therefore becomes necessary to forcibly regenerate the DPF 81 by such means as increasing the amount of fuel injection or by post-injection. This forced regeneration is set to be executed in automatic manner while the vehicle is traveling. Depending upon the operating conditions of the vehicle, however, the amount of deposition increases on the DPF and it often becomes necessary to forcibly execute the regeneration by also using the exhaust throttle valve 9. The device for purifying the exhaust gases of the present invention is provided with a manual regeneration switch 11 which is operated by the driver to execute the forced regeneration using the throttle valve 9 in combination, and provided also with a pilot lamp 12 for letting the driver know the necessity of forced regeneration and a warning lamp 13.

When the particulate matter trapped by the DPF 81 increases due to a decrease in the temperature of the exhaust gases, the pressure differential increases between the pressure on the upstream of the DPF 81 and the pressure on the downstream thereof. In the present invention, the pilot lamp 12 flashes when the temperatures detected by the inlet temperature sensor 84 and the outlet temperature sensor 85 of the oxidizing catalyst 82 become smaller than the predetermined values and when the pressure differential detected by the pressure differential sensor 83 exceeds a first predetermined value, recommending the driver to bring the vehicle into a halt and to push the manual regeneration switch 11 to conduct the forced regeneration by also using the throttle valve 9.

When the driver pushes the manual regeneration switch 11 in response to the flashing pilot lamp 12, the control unit for the device for purifying the exhaust gases stands by to be ready for conducting the forced regeneration. Here, if the driver brings the vehicle into a halt, returns the accelerator pedal back and lets the diesel engine 1 operate in idling condition, whence the DPF 81 starts forcibly regenerated by also using the throttle valve 9. This control operation is carried out by utilizing a detection signal of an accelerator pedal position sensor 14 and a signal of the engine rotational speed sensor 15, that are input to the ECU 10.

In this forced regeneration, the exhaust pipe 5 is greatly squeezed by decreasing the opening degree of the exhaust throttle valve 9 by operating the electromagnetic valve 91, and the feedback control of the diesel engine with the target idling speed value is performed to maintain the diesel engine 1 in idling condition. Here, even though the target value of the engine rotational speed is the idling speed, an increased load is exerted on the diesel engine 1 since the exhaust pipe 5 has been squeezed. Therefore, the fuel is injected in an amount larger than that of during the normal idling condition and, as a result, the temperature of the exhaust gases is elevated. Besides, in order to further elevate the temperature of the exhaust gas, this embodiment uses both means of multi-injection and post-injection. That is, by, first, being shifted to the multi-injection, the timing for injecting the fuel in the end of the compression stroke to the expansion stroke is substantially delayed to elevate the temperature of the exhaust gases. After the temperature of the inlet temperature sensor 84 of the oxidizing catalyst 82 has been elevated to higher value than a predetermined due to the multi-injection, the post-injection is effected in the end of the expansion stroke or in the exhaust stroke of the diesel engine 1. Upon elevating the temperature of the exhaust gases in advance as described above, a favorable oxidizing reaction of the fuel added by the post-injection is maintained by the oxidizing catalyst 82, and the DPF 81 is smoothly regenerated. The amount of injection by the post-injection may be divided into a multiplicity of steps and may be increased depending upon an increasing status in the temperature of the oxidizing catalyst 82 to accomplish more favorable adjustment.

If the driver does not operate the manual regeneration switch 11 due to some reason despite the pilot lamp 12 is flashing, or does not execute the forced regeneration, the particulate matter continues to deposit on the DPF 81 and the pressure differential sensor 83 detects a further increased pressure differential. When the pressure differential reaches a second predetermined value because of an increase in the amount of deposition of the particulate matter, the pilot lamp 12 flashes at an increased rate by shortening the period of flashing to recommend the driver to execute the forced regeneration at an early time. If the driver does not still execute the forced regeneration and the particulate matter continues to deposit causing the pressure differential to reach a third predetermined value, then, a warning lamp 13 turns on. The warning lamp 13 warns the driver to let him convince that the particulate matter has now been deposited in large amounts on the DPF 81 and the forced regeneration may produce an excess amount of heat due to the oxidation and burning of the particulate matter, which may cause damage to the DPF 81. In case the warning lamp 13 is turned on, the driver must bring the vehicle to a repair shop and have the deposited particulate matter removed by such a method as a so-called back washing or a combustion conducted using a long period of time. As described above, the device for purifying the exhaust gases of the present invention is provided with alarming means which produces alarming in three steps depending upon the amount of deposition of the particulate matter to provide the driver with detailed instructions for the forced regeneration.

As the forced regeneration starts and the oxidation and removal of the particulate matter based on the post-injection are continued for a predetermined period of time, the regeneration of the DPF 81 is completed. After the regeneration has been completed, the post-injection is discontinued, and the exhaust throttle valve 9 is returned back to the fully opened state. In the present invention, however, the target value of the rotational speed with which the feedback control is conducted is lowered prior to fully opening the exhaust throttle valve 9. That is, the target rotational speed of the diesel engine that used to be the idling speed during the forced regeneration is now lowered by, for example, about 200 rpm to operate the engine (see FIG. 2). Therefore, the amount of the exhaust gas of the diesel engine and the exhaust gas pressure decrease, and the internal pressure in the continuously regenerating DPF 8 decreases, too, as represented by a broken line in FIG. 2.

When the exhaust throttle valve 9 provided downstream of the continuously regenerating DPF 8 is fully opened as described earlier, the exhaust gas of a high pressure accumulated therein is suddenly released producing a large noise. According to the present invention, the rotational speed of the diesel engine is once decreased prior to opening the exhaust throttle valve 9. At a moment when the exhaust throttle valve 9 is opened, therefore, the pressure in the continuously regenerating DPF 8 has been lowered making it possible to greatly decrease the noise that is produced. There exists some delay time until the internal pressure in the continuously reproducing DPF 8 decreases after the target rotational speed in the feedback control has been decreased. Therefore, the exhaust throttle valve 9 is opened after having continued the operation of the engine at a decreased rotational speed for a predetermined period of time. The target rotational speed to be decreased is determined through experiments by taking into consideration a relationship between the exhaust gas pressure and the noise.

Figure 3:
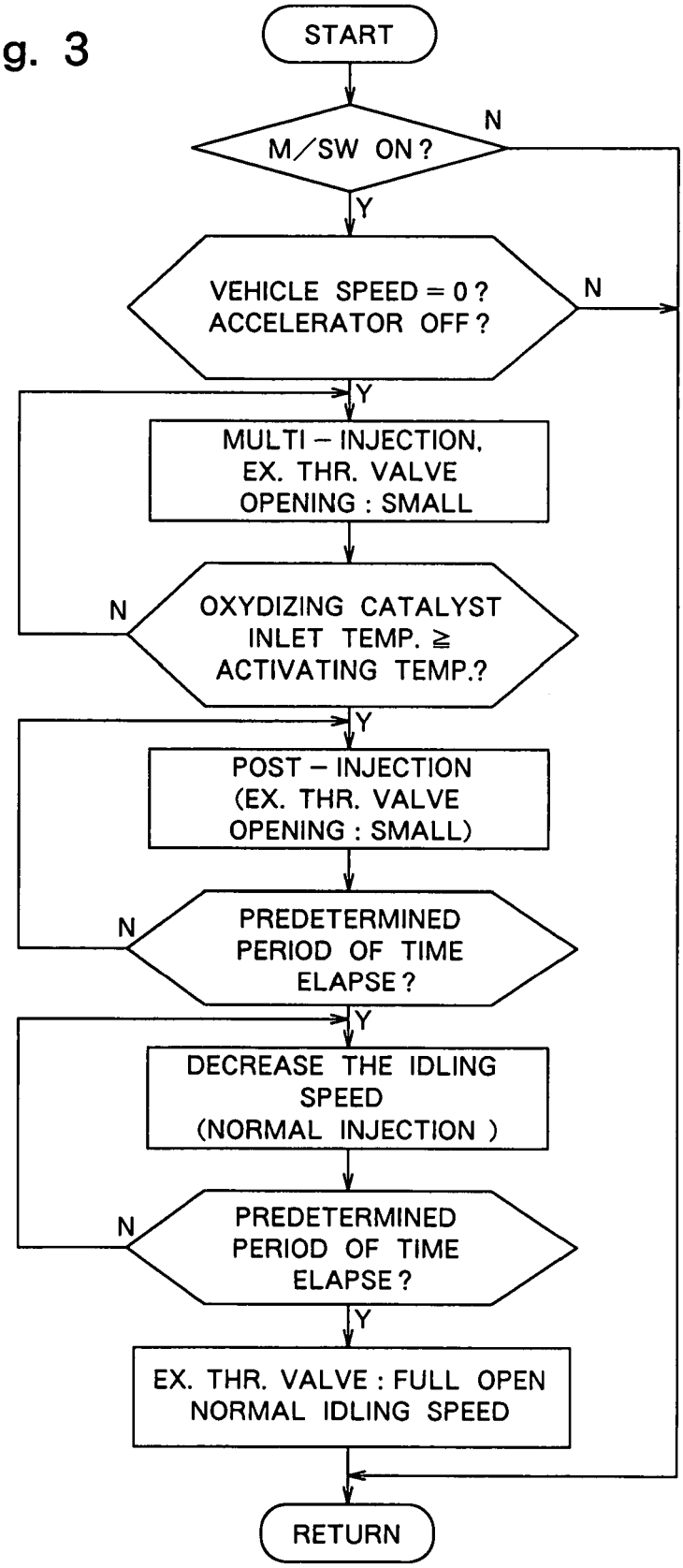
FIG. 3 is a flowchart illustrating the flow of control according to the present invention.

FIG. 3 is a flowchart illustrating a method of controlling the device for purifying the exhaust gases according to the present invention. If the driver turns the manual regeneration switch 11 on (S1) in response to the flashing pilot lamp 12, the routine stands by to be ready for executing the forced regeneration. Here, if the driver brings the vehicle into a halt and if it is detected that the accelerator pedal has no longer been depressed (S2), the forced regeneration starts. However, if these operations are not conducted, the flow of routine repeats without starting the forced regeneration.

When the condition of step 2 holds, the forced regeneration starts, the ECU 10 shifts the fuel injection for the diesel engine 1 to the multi-injection, and squeezes the exhaust pipe 5 by decreasing the opening degree of the exhaust throttle valve 9 (S3). Therefore, as the temperature of the exhaust gases rises and the inlet temperature of the oxidizing catalyst 82 exceeds the activating temperature of the catalyst which is, for example, 300° C. (S4), the ECU 10 sends an instruction for the post-injection to the fuel injection device (S5) and continues the post-injection for a predetermined period of time (S6) to regenerate the DPF 81. During this period, the accelerator pedal has not been depressed. Therefore, the diesel engine 1 is running at an idling speed and the exhaust throttle valve 9 remains opened to a small degree. The amount of the post-injection at step 5 may be set to be in two steps in a manner that the amount of injection increases with the passage of the time.

When the forced regeneration by the post-injection is executed for a predetermined period of time to complete the regeneration of the DPF 81, the ECU 10 decreases the target idling speed and, at the same time, discontinues the post-injection to return the fuel injection into the diesel engine 1 back to the normal state (S7). This operating condition continues (S8) until the rotational speed of the diesel engine 1 really decreases and the pressure in the continuously regenerating DPF 8 decreases. After the passage of the above time, the exhaust throttle valve 9 is fully opened (S9). Thus, the exhaust throttle valve 9 is opened without producing large noise, and the forced regeneration is completed.

Figure 4:
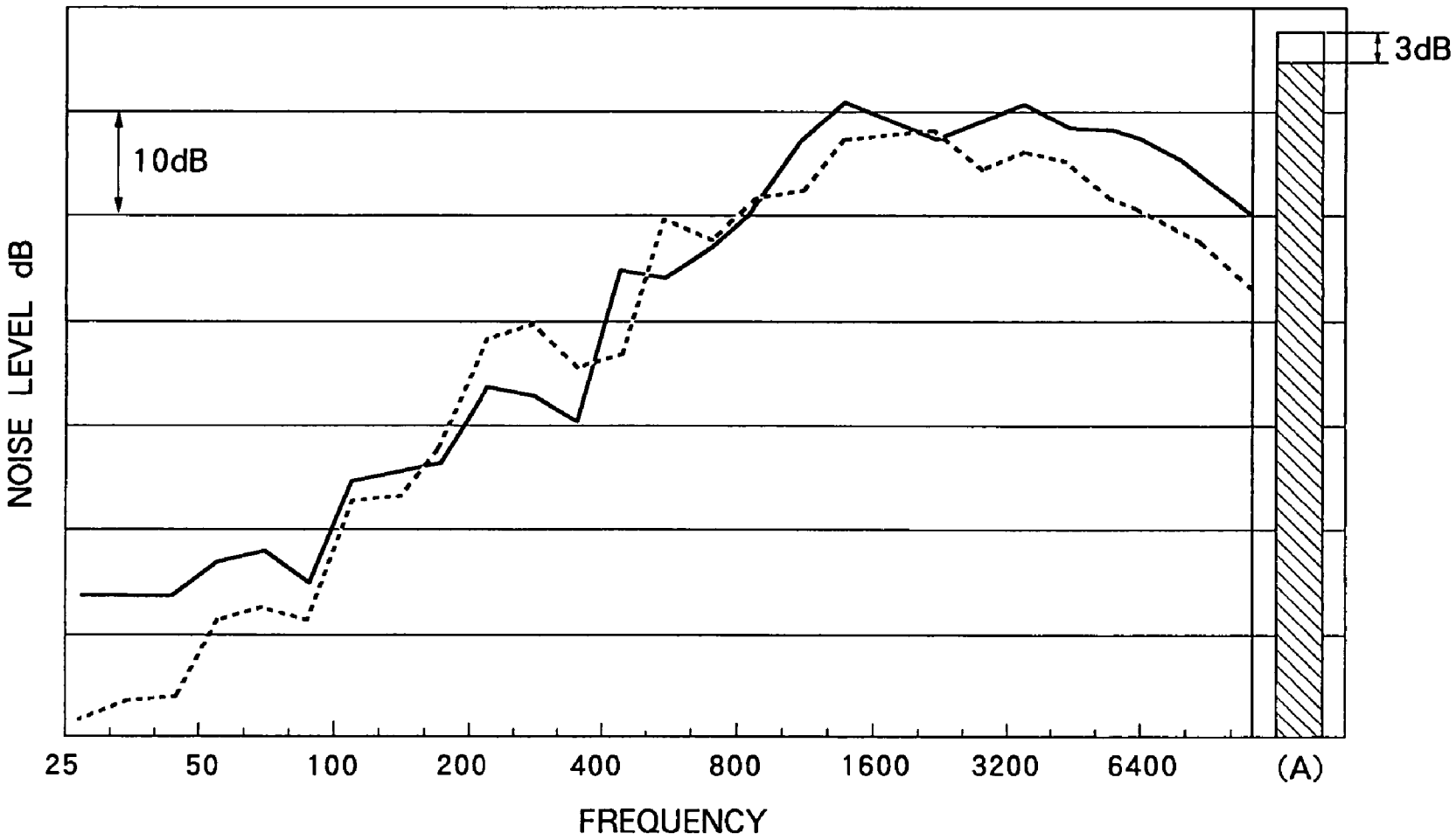
FIG. 4 is a graph of frequency characteristics illustrating a decrease in the noise according to the present invention.

Here, the noise produced when the exhaust throttle valve 9 is fully opened is compared in FIG. 4 between that of when the exhaust throttle valve 9 is fully opened while the engine is normally idling and that of when the rotational speed is decreased prior to fully opening the exhaust throttle valve 9. In FIG. 4, a solid line represents frequency characteristics of noise of the prior art and a broken line represents frequency characteristics in the case of the present invention, from which it will be understood that the noise is greatly decreased in the present invention as compared to the prior art particularly in the regions of high frequencies. The noise of high frequencies is offensive to human ears, and it can be said that a decrease in the noise level in these sound regions is very desirable. When the noise is totally evaluated in terms of the A-weighted sound pressure level, the result is a decrease in the noise level by 3 dB.

As described above in detail, it is an object of the present invention to provide a device for purifying the exhaust gases of a diesel engine equipped with the continuously regenerating DPF and the exhaust throttle valve in combination, which is capable of decreasing the noise at the time when the exhaust throttle valve is to be returned back to the fully opened state after the completion of the forced regeneration for removing the particulate matter deposited on the DPF with closing the exhaust throttle valve. To accomplish this object, the present invention further provides engine controlling in which engine rotational speed during the forced regeneration is decreased prior to fully opening the exhaust throttle valve. Therefore, the present invention can be applied not only to the continuously regenerating DPF having a separate catalyst disposed on the upstream of the DPF described in the above embodiment, but also to the continuously regenerating DPF in which, for example, the surfaces of the DPF are coated with a catalyst. Further, it is apparent that, as means for elevating the temperature of the exhaust gases in the forced regeneration, other means than the post-injection or the multi-injection, for example, a device for adding the fuel provided in the exhaust system, can be applied to the present invention.

What is claimed is:

1. A diesel engine comprising:

a continuously regenerating DPF comprising:

a diesel particulate filter for trapping particulate matter contained in the exhaust gases; and a catalyst provided on the upstream thereof; and an exhaust throttle valve on the downstream of the continuously regenerating DPF, said exhaust throttle valve becoming to a small opening degree state when the diesel engine is operated for regenerating the diesel particulate filter by oxidizing and removing the particulate matter deposited on the diesel particulate filter and becoming to a large opening degree state when said regenerating is finished;

wherein the diesel engine is operated to decrease a rotational speed when the regenerating of the diesel particulate filter has finished and, after the diesel engine is operated to decrease the rotational speed, the exhaust throttle valve becomes to the large opening degree state, and wherein the diesel engine is installed in a vehicle, and when the diesel engine is operated for the regenerating of the diesel particulate filter where the exhaust throttle valve is in the small opening degree state, the vehicle is brought into a halt and the diesel engine is operated in idling condition.

2. A diesel engine according to claim 1, wherein in operating the diesel engine in idling condition, a feedback control is executed with the idling rotational speed as a target value and when the regeneration of the diesel particulate filter is finished, the target value is decreased to decrease the rotational speed of the diesel engine.

3. A diesel engine according to claim 1, wherein an alarm device is provided to let the driver know the fact that the particulate matter in the exhaust gases has deposited in amounts greater than a predetermined amount on the diesel particulate filter.

4. A diesel engine according to claim 3, wherein said alarm device comprises a plurality of warning lamps, each of said plurality of warning lamps being activated at a different predetermined amount of said particulate matter deposited on the diesel particulate filter.

5. A diesel engine according to claim 1, further comprising a manual regeneration switch for manually executing said regenerating.

6. A diesel engine comprising:

a continuously regenerating DPF comprising:

a diesel particulate filter for trapping particulate matter contained in the exhaust gases; and a catalyst provided on the upstream thereof; and an exhaust throttle valve on the downstream of the continuously regenerating DPF, said exhaust throttle valve becoming to a small opening degree state when the diesel engine is operated for regenerating the diesel particulate filter by oxidizing and removing the particulate matter deposited on the diesel particulate filter and becoming to a large opening degree state when said regenerating is finished;

wherein the diesel engine is operated to decrease a rotational speed when the regenerating of the diesel particulate filter has finished and, after the diesel engine is operated to decrease the rotational speed, the exhaust throttle valve becomes to the large opening degree state, wherein when the diesel engine is operated for the regenerating of the diesel particulate filter where the exhaust throttle valve is in the small opening degree state, the fuel is added from a fuel injection nozzle of the diesel engine in the expansion stroke or in the exhaust stroke, and wherein when the diesel engine is operated for the regenerating of the diesel particulate filter, the fuel injection of the diesel engine in the end of compression stroke to the expansion stroke, is performed by multi-stage fuel injection, and after the temperature of the exhaust gases has reached a predetermined value, the additional fuel is injected from the fuel injection nozzle of the diesel engine in the expansion stroke or in the exhaust stroke.

7. A method of purifying exhaust gases of a diesel engine having a diesel particulate filter and an exhaust throttle valve downstream of the diesel particulate filter, the method comprising:

operating the diesel engine in a state where an exhaust throttle valve becomes to a small opening degree in order to regenerate a diesel particulate filter by oxidizing and removing particulate matter deposited on the diesel particulate filter, operating the diesel engine at a decreased rotational speed at a moment when the regenerating the diesel particulate filter is complete; and opening the exhaust throttle valve to a large opening degree after said operating the diesel engine at said decreased rotational speed.

8. The method according to claim 7, further comprising:

installing the diesel engine in a vehicle;

bringing the vehicle into a halt; and operating the diesel engine in an idling condition for the regeneration of the diesel particulate filter where the exhaust throttle valve becomes to the small opening degree.

9. The method according to claim 8, further comprising:

executing a feedback control with the idling rotational speed as a target value when the diesel engine is operated in the idling condition, wherein when the regenerating of the diesel particulate filter is finished, the target value is decreased to decrease the rotational speed of the diesel engine.

10. The method according to claim 7, further comprising adding fuel from a fuel injection nozzle of the diesel engine in an expansion stroke or in an exhaust stroke when the diesel engine is operated for the regenerating of the diesel particulate filter where the exhaust throttle valve is in the small opening degree state.

* * * * *